US010791899B2

(12) United States Patent
Carter

(10) Patent No.: US 10,791,899 B2
(45) Date of Patent: Oct. 6, 2020

(54) VACUUM HOSE ATTACHMENT APPARATUS

(71) Applicant: Dennis Carter, Washington, DC (US)

(72) Inventor: Dennis Carter, Washington, DC (US)

( * ) Notice: Subject to any disclaimer, the term of this patent is extended or adjusted under 35 U.S.C. 154(b) by 8 days.

(21) Appl. No.: 16/153,140

(22) Filed: Oct. 5, 2018

(65) Prior Publication Data

US 2019/0239708 A1 Aug. 8, 2019

Related U.S. Application Data

(63) Continuation-in-part of application No. 15/892,176, filed on Feb. 8, 2018.

(51) Int. Cl.

| | |
|---|---|
| ***A47L 9/24*** | (2006.01) |
| ***A47L 9/06*** | (2006.01) |
| ***A47L 11/40*** | (2006.01) |
| *A47L 5/24* | (2006.01) |
| *A47L 5/28* | (2006.01) |

(52) U.S. Cl.

CPC ..... *A47L 9/242* (2013.01); *A47L 9/0606* (2013.01); *A47L 9/0693* (2013.01); *A47L 11/4044* (2013.01); *A47L 5/24* (2013.01); *A47L 5/28* (2013.01)

(58) Field of Classification Search

CPC ..... A47L 9/0693; A47L 11/4044; A47L 5/24; A47L 5/28; A47L 9/02; A47L 9/0606; A47L 9/242; B08B 5/04; B60S 3/008

See application file for complete search history.

(56) References Cited

U.S. PATENT DOCUMENTS

| | | | | |
|---|---|---|---|---|
| 6,484,357 | B1 * | 11/2002 | Dong | A47L 9/06 15/397 |
| D658,832 | S * | 5/2012 | Eden | D32/32 |
| 8,533,907 | B2 * | 9/2013 | Eccardt | A47L 9/02 138/122 |
| D714,005 | S * | 9/2014 | McGurk | D32/32 |
| 2002/0170140 | A1 * | 11/2002 | Diaz | A47L 9/02 15/415.1 |
| 2007/0209154 | A1 * | 9/2007 | Griffith | A47L 5/30 15/415.1 |
| 2010/0170060 | A1 * | 7/2010 | Eccardt | A47L 5/36 15/415.1 |
| 2013/0125329 | A1 * | 5/2013 | Shrum | A47L 9/02 15/246.2 |
| 2013/0326843 | A1 * | 12/2013 | Schwartz | A47L 9/02 15/415.1 |
| 2018/0055311 | A1 * | 3/2018 | Conrad | A47L 5/32 |
| 2019/0239706 | A1 * | 8/2019 | Carter | B60S 3/008 |

* cited by examiner

*Primary Examiner* — Marc Carlson

(74) *Attorney, Agent, or Firm* — Michael L. Greenberg, Esq.; Greenberg & Lieberman, LLC

(57) ABSTRACT

A vacuum attachment apparatus for use on conventional service station or car wash vacuums is described. The apparatus is equipped with a rubberized female portion disposed on a wide end of the apparatus, which is configured to mate onto the default vacuum hose end. The apparatus facilitates the cleaning of small crevices with a commercial or industrial vacuum, which conventionally has too large of an intake to reach crevices such as those found between the seats of vehicles, under the seats, within the dash, and in other common locations standard on most contemporary vehicles.

10 Claims, 6 Drawing Sheets

VACUUM HOSE ATTACHMENT APPARATUS

CONTINUITY

This application is a continuation application of utility patent application Ser. No. 15/892,176, filed on Feb. 8, 2018, and priority is claimed thereto.

FIELD OF THE PRESENT INVENTION

The present invention relates to vacuum cleaners, and more specifically relates to an attachment for a vacuum hose of a commercial automotive vacuum conventionally found at car washes, service stations, and fuel stations.

BACKGROUND OF THE PRESENT INVENTION

It is known that vehicles often become dirty after prolonged use. This is equally true for the outside of the vehicle as well as the inside of the vehicle. Conventionally, vehicle owners are known to travel to car washes to clean their vehicles. Often, these facilities are equipped with large, commercial-style vacuums, which are permanent fixtures of the car wash. Such vacuums are also conventionally found at gas stations. The vacuums as such locations are usually coin operated, and are equipped with a single hose which is much larger than conventional household vacuums. Due to their size and power ratings, the vacuums such as these often have great suction strength.

Unfortunately, these vacuums are usually equipped with a single, non-adjustable nozzle (vacuum hose end), which may not be removed from the hose. This limitation of the vacuum limits the efficacy of the vacuum within most vehicles. For example, the large hose nozzle/end is too large to fit between most vehicle seats, and provides limited range to reach under seats. Additionally, crevices, such as those on the dashboard, instrument panel, door-based armrests, AC vents, and other small spaces are out of reach to the standard vacuum hose found on most car wash or service station vacuums.

Additionally, the default nozzle of a conventional industrial/commercial vacuum cleaner is often dirty and unsanitary from constant use. There is a need for the user to have a way to use default nozzle of a conventional industrial/commercial vacuum cleaner while having the semblance of using a personal vacuum.

Few solutions for these issues are present on the market. A product marketed as "The Little Anteater" Car Wash Vacuum Crevice Tool Attachment by Ronexa LLC., seen at: (https://www.amazon.com/little-ameater-Vacuum-Crevice-Attachment/dp/B00A7ZKAZ1/ref=lp_13955990011_1_1?srs=13955990011&ie=UTF8&qid=15 16225371&sr=8-1) presents a tool that attempts to solve the aforementioned problems. However, the device taught by Ronexa LLC is configured to fit within the default nozzle of a conventional industrial/commercial vacuum cleaner. Fitting within is not the most desirable, as the dirty and marred end of the default nozzle of a conventional industrial/commercial vacuum cleaner still present and exposed. So while the user employs the device taught by Ronexa LLC, the user can unintentionally rub the exposed default nozzle of a conventional industrial/commercial vacuum against seats and other parts of the car that the user is cleaning. Marred ends of the default nozzle of a conventional industrial/commercial vacuum are often sharp and carry remnants of dirt from prior use, so although the device taught by Ronexa LLC makes the default nozzle of a conventional industrial/commercial vacuum cleaner easier to use, the user still is left with a solution that does not provide a clean end for vacuuming. Further, the user still faces a dirty and possibly damaging default nozzle of a conventional industrial/commercial vacuum cleaner.

Other flexible vacuum crevice tools on the market, such as the "Universal High Quality Flexiclean Flexible Crevice Tool" found at https://www.ebay.com/itm/Universal-30-36-mm-High-Quality-Universal-Flexiclean-Flexible-Crevice-Tool/142524506902?_trkparms-aid%3D22.2007%26algo%3DSIM MBE%26ao%3D2%26asc% 3D41375%26meid%3D17f21c8d3cd24e83baeac28 fb821977f%26pid%3D100623%26rk%3D4% 26rkt%3D6%26sd%3D151935731160&_trksid= p2047675.c100623.m-1 are configured to attach to a vacuum hose. However, these tools are not geared for use on an industrial car wash or service station automotive vacuum. Unlike the present invention, such crevice tools are designed for use with standard household vacuums, and do not offer a solution for crevice cleaning via a car wash vacuum. Additionally, the crevice tool taught in the aforementioned link is equipped with a rounded brush, unlike that of the present invention, and the crevice tool of the aforementioned link is not designed to direct suction in the same manner as that of the present invention. Moreover, the crevice tool taught in the aforementioned link seems to be a hose, not a somewhat rigid tool—so it would seemingly be hard to manipulate reliably because the hose sill naturally want to bend in different directions.

There is a need to make the default nozzle of a conventional industrial/commercial vacuum cleaner able to reach crevices, while at the same time, giving the user an experience free of conveying dirt to the vehicle the user is cleaning. And there is also a need to render the default nozzle of a conventional industrial/commercial vacuum cleaner unable to damage a vehicle being cleaned—as frequent use of the default nozzle of a conventional industrial/commercial vacuum cleaner oftentimes causes it to be cracked, scratched, partially broken, and otherwise not suitable for use in a prized vehicle.

Notably, the art taught by Ronexa LLC is not equipped with a rubberized or plastic covering of the rim of the default nozzle of the vacuum hose. If there were a device which encompasses the entire rim of the default vacuum nozzle with a lip or rim, additional accidental contamination of the vehicle by the default vacuum nozzle could be eliminated.

Thus, there is a need for a new vacuum attachment apparatus configured for use with conventional industrial/commercial vacuum cleaners often found at car washes, service stations, and gas stations. Such an apparatus is preferably equipped with way of mating the apparatus to the default gas station vacuum nozzle without loss of suction, having protection from the dirt-laden and possibly sharp nozzle. It would be desirable for such an apparatus to allow access to small vehicle crevices. It would also be desirable for such an apparatus to have design elements to loosen dirt stuck in the vehicle, as well as better ways to actually locate dirt in the vehicle.

SUMMARY OF THE PRESENT INVENTION

This Summary of the Invention is provided to introduce a selection of concepts in a simplified form that are further described below in the Detailed Description. This Summary is not intended to identify key features or essential features of the claimed subject matter, nor is it intended to be used to limit the scope of the claimed subject matter.

The present invention is a vacuum hose attachment accessory apparatus configured for use on industrial/commercial vacuum cleaners often found at car washes, gas stations, and service stations. The apparatus is equipped with a wide end and a narrow end. The wide end has a rubberized female portion, which is configured to stretch over the default vacuum hose end disposed on large, stationary vacuum cleaners. As the standard or default vacuum hose end is often quite large, it is unable to effectively clean within small crevices disposed within most vehicles, such as between the seats, under the seats, within the dash, etc. The wide end preferably has a rounded shape.

The narrow end is equipped with an intake opening, which is approximately 1.5 inches in diameter. The narrow end is preferably angled, and is tapered such that a neck of the narrow end reaches a point. Flattened tubing is present at the neck portion of the apparatus, which extends between the wide end and the narrow end. The flattened tubing facilitates the collection of dirt and debris from within small spaces of the vehicle. Additionally, use of the present invention helps to ensure that 'gunk' (effectively a mixture of dirt, moisture, and other debris congealing) does not build up on the floor of the vehicle. The present invention also has a hook that is designed for scraping at gunk build-up, allowing it to be loosened and then easily captured by the suction of the vacuum.

The present invention is configured to stretch over and around the existing default nozzle of the conventional industrial/commercial vacuum cleaner. As the present invention is designed with an elastic, rubberized material, the present invention is more suitable for use on a wider variety of default vehicle vacuum nozzles than that of the prior art.

By stretching over and around the existing default nozzle of the conventional industrial/commercial vacuum cleaner, the dirty and possibly abrasive default nozzle of the conventional industrial/commercial vacuum cleaner is covered and obscured. Thus, the user has a clean experience while using a public vacuum. It is envisioned that the user would bring the present invention that the user owns, and thereby not have to deal with the dirty and possibly abrasive default nozzle of the conventional industrial/commercial vacuum cleaner.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

Figure 1:
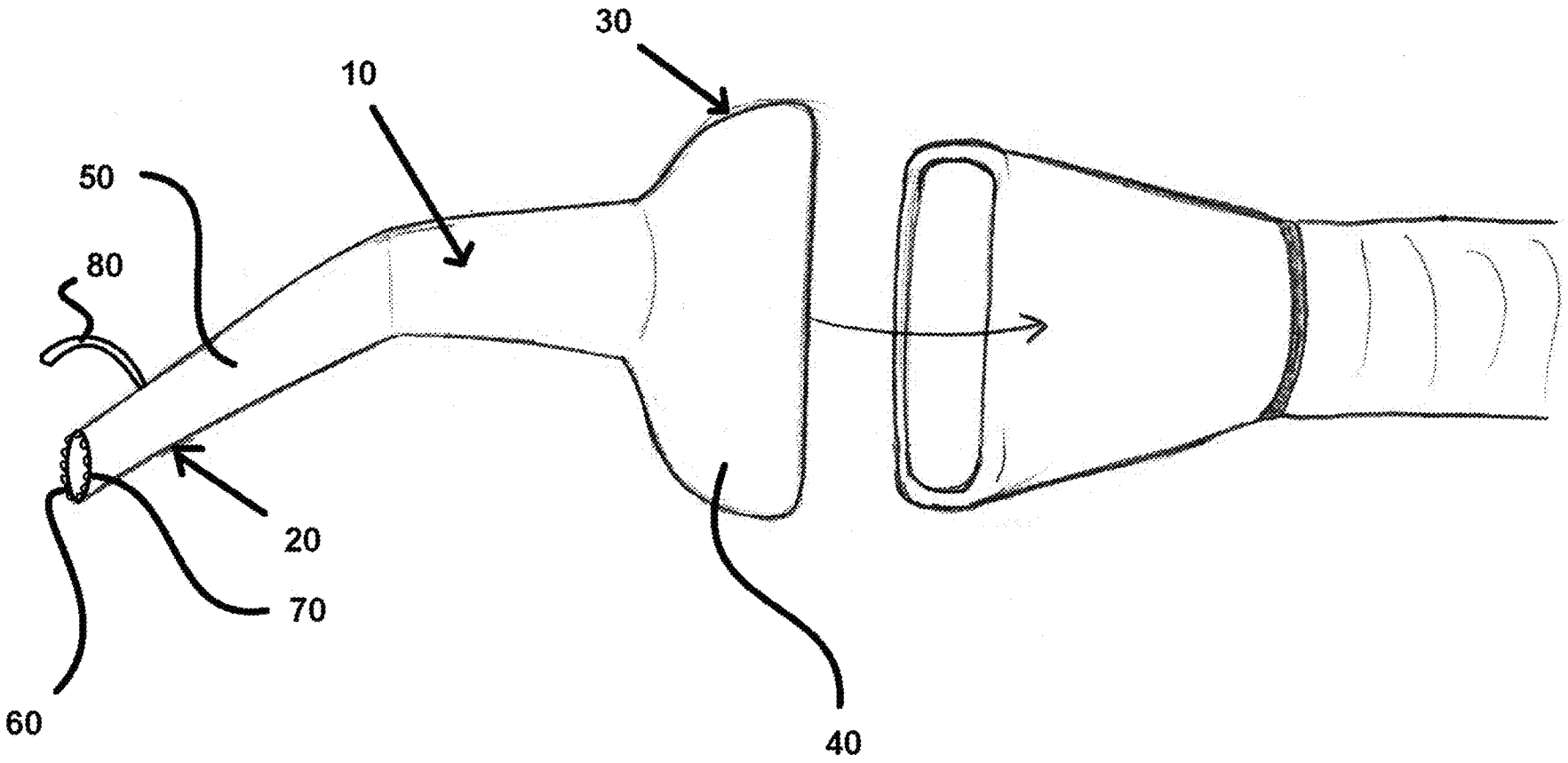
FIG. 1 depicts a view of the front of the vacuum attachment apparatus of the present invention, showing how it attaches to a commercial vacuum conventionally found at car washes and service stations.

The present specification discloses one or more embodiments that incorporate the features of the invention. The disclosed embodiment(s) merely exemplify the invention. The scope of the invention is not limited to the disclosed embodiment(s). The invention is defined by the claims appended hereto.

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, The present invention is a vacuum attachment apparatus configured to affix to the standard oversized inlet of a gas station or car wash vacuum cleaner (referenced as an industrial/commercial vacuum). The apparatus has a body (10) which is equipped with a narrow end (20) and a wide end (30). The wide end (30) is equipped with a rubberized female portion (40), which is configured to stretch over and around the default nozzle of the gas station vacuum, as shown in FIG. 1.

The narrow end (20) is equipped with a flattened tube (50) which is equipped with an intake opening (60). The intake opening (60) is approximately 1.5 inches in diameter, and is preferably tapered such that it ends at a point, as shown in FIG. 1 and FIG. 2. The flattened tube (50) portion of the narrow end (20) is preferably angled as depicted in FIG. 1 and FIG. 2, however alternate embodiments of the present invention may not employ an angled narrow end (20), and may instead be straight.

Figure 2:
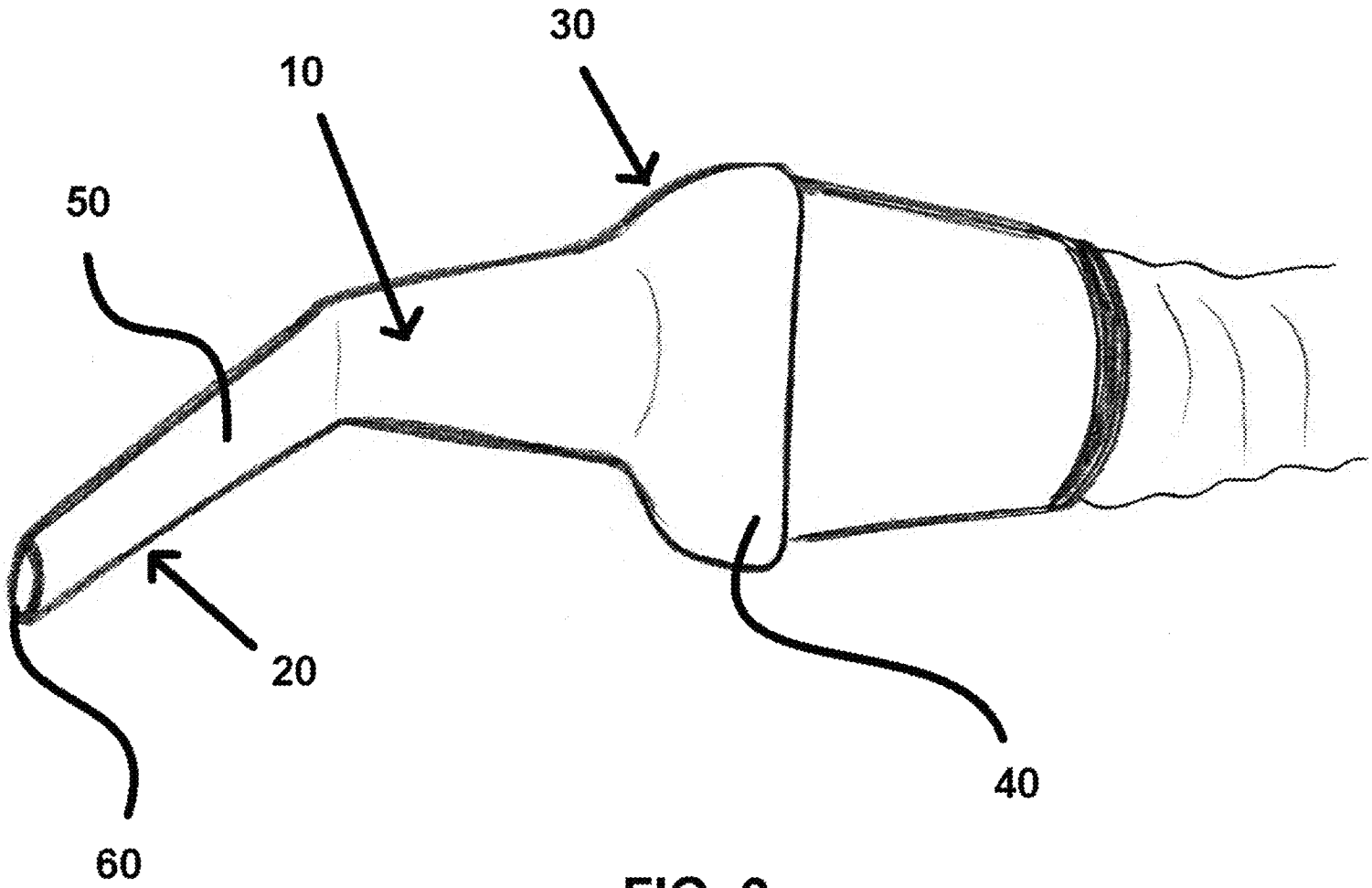
FIG. 2 exhibits a view of the side of the vacuum attachment of the present invention, as depicted attached to the vacuum hose of the commercial vacuum conventionally found at car washes and service stations.
Figure 3:
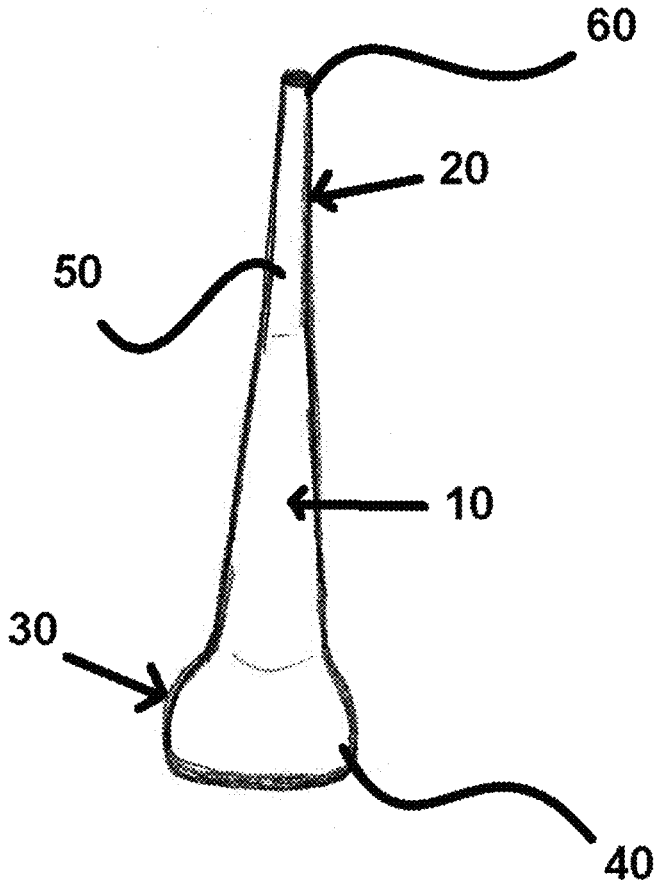
FIG. 3 shows a top view of the vacuum attachment of the present invention, detailing the narrow tip and flattened tubing of the apparatus.

The wide end (30) preferably has a rounded shape, which tapers outward towards the rubberized female portion (40), as shown in FIG. 1 and FIG. 2. The rubberized female portion (40) is configured to expand such that it may easily be affixed to the rim of the default vacuum hose nozzle. A silicone or similar stretchable polymer may be used in lieu of rubber in some embodiments of the present invention. For example, rubber, Flexiclear™, or a silicone composite may be employed as the rubberized female portion (40) of the present invention.

Alternate embodiments of the present invention include variations on the size of the intake opening (60), as well as the shape of the intake opening (60). For example, in some embodiments of the present invention, the intake opening (60) may be elliptical or squared. In other embodiments, the intake opening may be larger than 1.5 inches, in contrast to the preferred embodiment of the present invention. Additionally, as shown in FIG. 1, preferred embodiments of the intake opening (60) are equipped with ridges (70), which are present to facilitate loosening of debris/gunk from within crevices of a vehicle. A hook (80) is also preferably present near the intake opening (60) on the narrow end (20), which is configured to facilitate loosening and ultimate removal of stubborn or heavy-set debris/gunk found within crevices and floorboards of soiled vehicles. The hook (80) may be configured to extend out from the intake opening (60) when needed, and be retracted back within or onto the intake opening (60) when not needed. The retraction of the hook (80) is important when the user is attempting to place the intake opening (60) of the present invention into a crevice so small that the intake opening (60) would not fit into the crevice unless the hook (80) is retracted. The hook (80) is preferably configured to extend and retract about a pivoting hinge.

Figure 4:
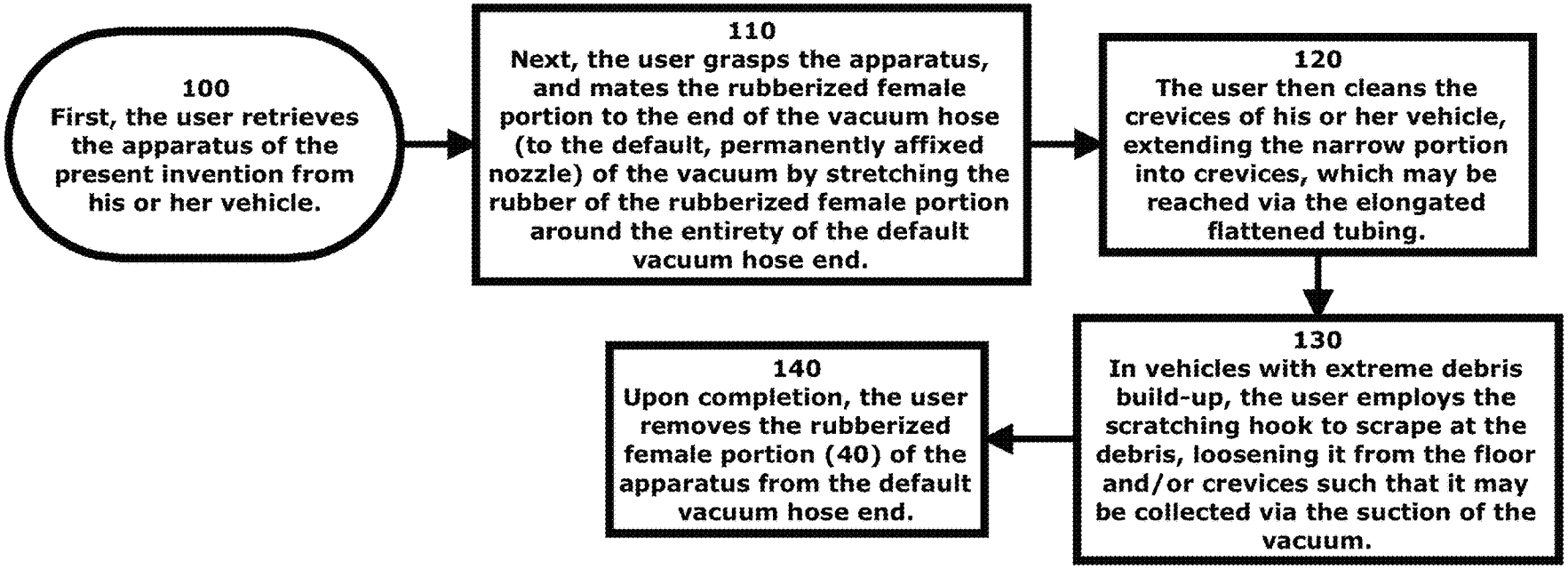
FIG. 4 displays a flow chart detailing the process of installation and use of the apparatus of the present invention.

The process of use of the apparatus of the present invention, as depicted in FIG. 4, is preferably as follows:

1. First, the user retrieves the apparatus of the present invention from his or her vehicle. (100) Alternately, the apparatus of the present invention may be disposed at the car wash or service station for use by its customers. In such cases, the apparatus of the present invention could be reserved behind a clerk counter of the service station/car wash, or may be affixed on or near the vacuum via a tether or chain to prevent theft. The attachment apparatus may also be purchased from the car wash or service station in some locations. Preferably, the user owns the apparatus, and keeps it in his or her vehicle until cleaning is needed.

2. Next, the user grasps the apparatus, and mates the rubberized female portion (40) to the end of the vacuum hose (to the default, permanently affixed nozzle) of the vacuum by stretching the rubber of the rubberized female portion (40) around the entirety of the default vacuum hose end. (110)

3. The user then cleans the crevices of his or her vehicle, extending the narrow portion (50) into crevices, which may be reached via the elongated, flattened tubing (50). (120)

4. In vehicles with extreme debris build-up, the user employs the hook (80) to scrape at the debris, loosening it from the floor and/or crevices such that it may be collected via the suction of the vacuum. (130)

5. Upon completion, the user removes the rubberized female portion (40) of the apparatus from the default vacuum hose end. (140)

Some alternate embodiments of the present invention may be equipped with one or more lights to facilitate illumination of dark crevices within a vehicle. In such embodiments, at least one light is preferably disposed on the outside of the intake opening (60), near the hook (80), and is configured to cast light down and away from the intake opening (60) to illuminate debris prior to capture within the intake opening (60). In such embodiments, the at least one light is preferably powered via a conventional button-cell battery, housed in a battery compartment disposed adjacent to the light. The battery is connected to at least one light bulb via at least one wire.

Additionally, some embodiments of the present invention may be bundled with additional adapter tips which are configured to fit over the intake opening (60) of the present invention. Such adapter tips amount to interchangeable tips, which have an even smaller intake diameter/size than that of the default intake opening (60) of the present invention. Such adapter tips are configured for use on micro-crevices of a vehicle, such as those found near the automatic gear shift, within automatic window switches, within vehicle ashtray (or similar) compartments, or within air conditioning and heating vents.

In other embodiments of the present invention, more than one hook (80) may be disposed on the intake opening (60), each of which may be configured to extend or contract when needed. In embodiments having more than one hook (80), each iteration of the hook (80) is preferably of a different size and may have a different curvature to facilitate the loosening of gunk/dirt from differing locations within the vehicle, such as scraping the floor under a seat of the vehicle more easily.

Additionally, in other embodiments of the present invention, the apparatus may be equipped with a handle to further facilitate manipulation of the intake opening (60) into the desired position for cleaning of a specific area of the vehicle.

It should be understood that the present invention is configured for use on conventional car wash and gas station industrial/commercial vacuums, which are often equipped with dirty and/or marred default nozzles. The present invention ensures that users need not have the marred and/or dirty default nozzle of the industrial/commercial vacuum fouling or damaging the vehicle by coming into contact with the interior of the vehicle during use. As such, the rubberized female portion (40) of the wide end (30) is configured to completely surround and encompass the potentially marred and/or dirty default tip of the default nozzle of the industrial/commercial vacuum, preventing contamination of the vehicle during use.

Figure 5:
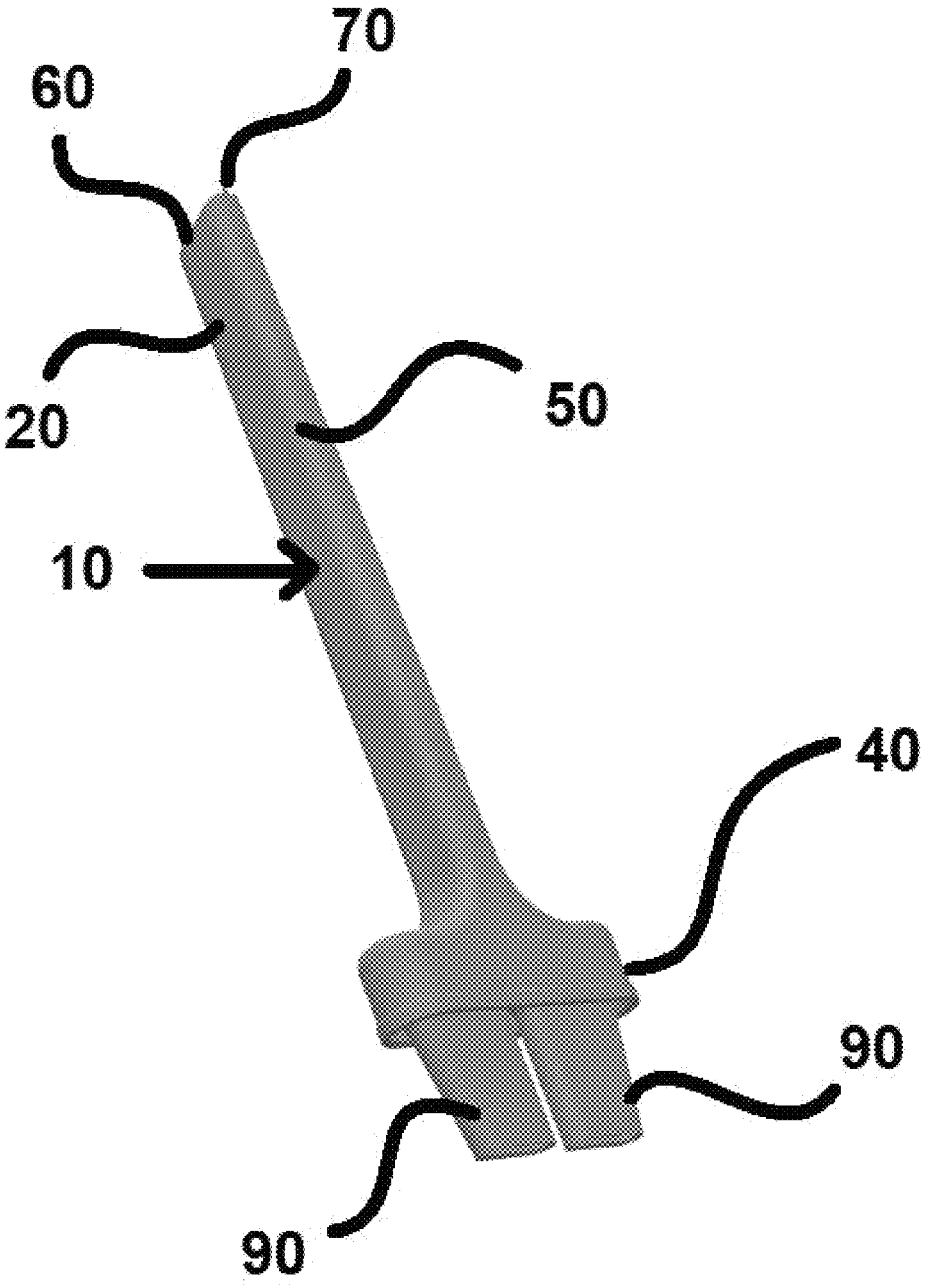
FIG. 5 depicts a second preferred embodiment of the vacuum attachment of the present invention as seen from the top and side.
Figure 6:
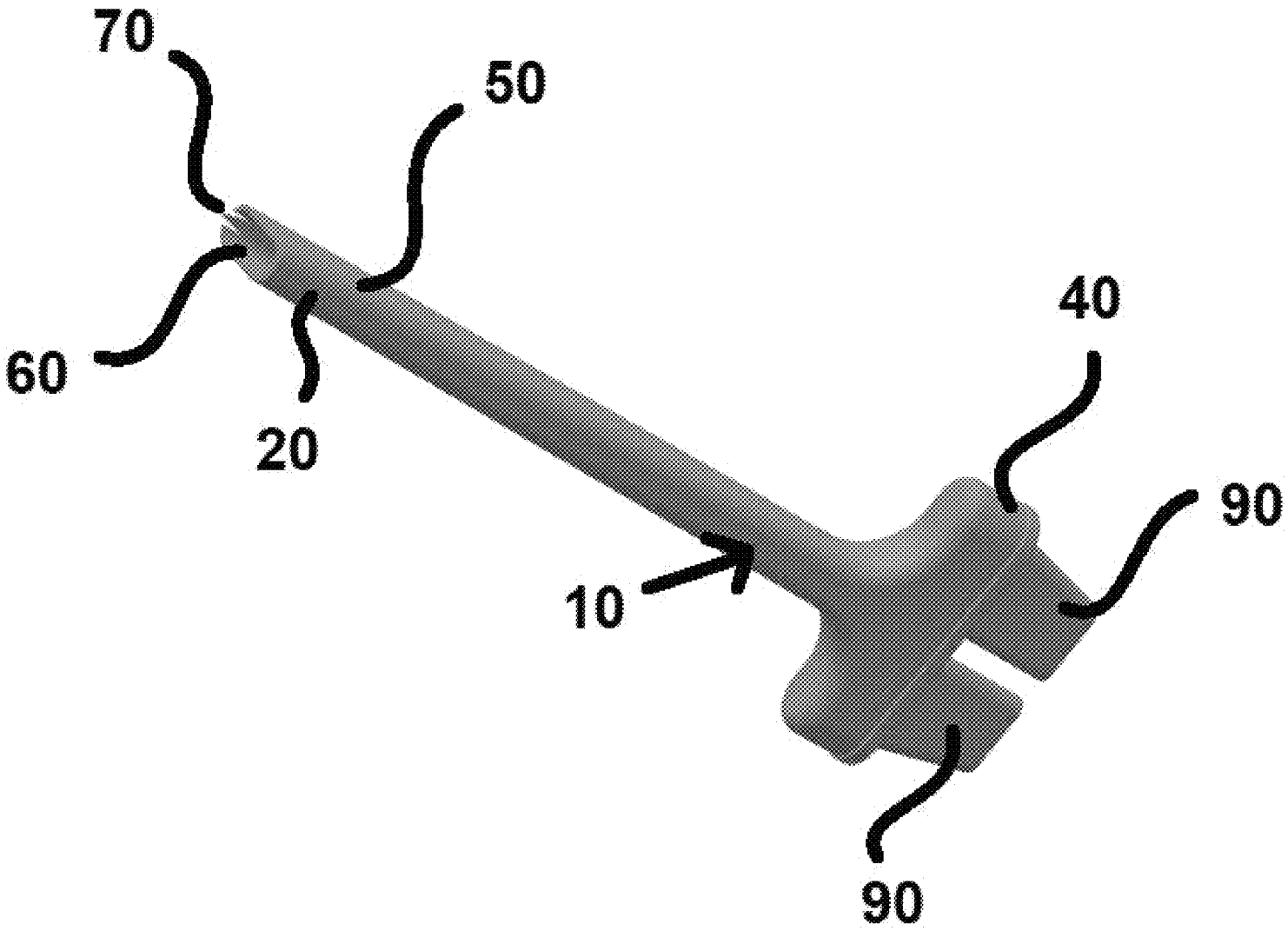
FIG. 6 depicts the second preferred embodiment of the vacuum attachment of the present invention as seen from the bottom and side.

An alternate preferred embodiment of the present invention is depicted in FIG. 5 and FIG. 6. This alternate preferred embodiment of the present invention is equipped with hollow protrusions (90) which extend from the wide end (30), and are fixed within an inside of the rubberized female portion (40) of the present invention. As shown, the protrusions (90) are designed to extend into the default vacuum nozzle of the car wash or gas station vacuum. The protrusions (90) are hollow so as to ensure that the suction of the vacuum is channeled through the hollow cavity within the protrusions to the intake opening (60). The protrusions (90) are present in order to help ensure that the present invention remains affixed to the default vacuum nozzle of the vacuum during use, and aide the rubberized female portion (40) in ensuring firm adhesion of the present invention to the default nozzle.

Some versions of the present invention related to the alternate preferred embodiment depicted in FIG. 5 and FIG. 6 may not require a rubberized female portion (40), as the protrusions (90) alone are adequate in ensuring sufficient suction channeled from the vacuum through the apparatus to the intake opening (60). Additionally, it should be noted that the ridges (70) of this second preferred embodiment are present in the form of a single ridge (70) or notch formed by a V-cut at the angled tip of the intake opening (60). Such embodiments may be less expensive to manufacture due to the decreased reliance on flexible rubber components. In such embodiments, the flattened tube (50) is preferably approximately ten inches in length, however it is envisioned that other embodiments of the present invention may have a flattened tube (50) of a shorter or longer length.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A crevice cleaning tool adapter apparatus configured to attach to a default nozzle of an industrial/commercial vacuum comprising:

a body, said body having a crevice tool end and a vacuum hose connection end;

said crevice tool end comprising an elongated flattened tube and a narrow intake opening, said vacuum hose connection end fluidically connected to said narrow intake opening and configured to receive said default nozzle, said vacuum hose connection end comprising a channel sized and shaped to extend around an outer perimeter of an intake end of said default nozzle allowing said intake end to fit inside said channel when assembled, said vacuum hose connection end comprising at least one hollow protrusion configured to extend from inside said channel in a direction opposite said crevice tool end and sized and shaped to fit inside said intake end of said default nozzle when assembled.

2. The apparatus of claim 1, wherein said at least one hollow protrusion is a one hollow protrusion configured to extend in a direction opposite said crevice tool end and sized and shaped to fit inside said intake end of said default nozzle when assembled.

3. The apparatus of claim 1, wherein said at least one hollow protrusion is a two hollow protrusions configured to extend in a direction opposite said crevice tool end and sized and shaped to fit inside said intake end of said default nozzle when assembled.

4. The apparatus of claim 1, wherein said nozzle intake opening is angled at its distal end;

wherein a widest width of said flattened tube is perpendicular to a widest width of said vacuum hose connection end; and wherein said widest width of said flattened tube is perpendicular to a widest width of said at least one hollow protrusion.

5. The apparatus of claim 1, wherein said nozzle intake opening is angled at its distal end and comprises at least one ridge formed by adjacent notches in said nozzle intake opening.

6. A crevice cleaning tool adapter apparatus configured to attach to a default nozzle of an industrial/commercial vacuum comprising:

a body, said body having a crevice tool end and a vacuum hose connection end;

said crevice tool end comprising an elongated flattened tube and a narrow intake opening, said vacuum hose connection end fluidically connected to said narrow intake opening and configured to receive said default nozzle, said vacuum hose connection end comprising a channel sized and shaped to extend around an outer perimeter of an intake end of said default nozzle allowing said intake end to fit inside said channel when assembled, said vacuum hose connection end comprising two hollow protrusions both configured to extend from inside said channel in a direction opposite said crevice tool end and sized and shaped to fit inside said intake end of said default nozzle when assembled.

7. The apparatus of claim 6, wherein said nozzle intake opening is angled at its distal end;

wherein a widest width of said flattened tube is perpendicular to a widest width of said vacuum hose connection end; and wherein said widest width of said flattened tube is perpendicular to a widest width of said at least one hollow protrusion.

8. The apparatus of claim 6, wherein said nozzle intake opening is angled at its distal end and comprises at least one ridge formed by adjacent notches in said nozzle intake opening.

9. A crevice cleaning tool adapter apparatus configured to attach to a default nozzle of an industrial/commercial vacuum comprising:

a body, said body having a crevice tool end and a vacuum hose connection end;

said crevice tool end comprising an elongated flattened tube and a narrow intake opening, wherein said nozzle intake opening is angled at its distal end;

wherein a widest width of said flattened tube is perpendicular to a widest width of said vacuum hose connection end; and wherein said widest width of said flattened tube is perpendicular to a widest width of said at least one hollow protrusion said vacuum hose connection end fluidically connected to said narrow intake opening and configured to receive said default nozzle, said vacuum hose connection end comprising a channel sized and shaped to extend around an outer perimeter of an intake end of said default nozzle allowing said intake end to fit inside said channel when assembled, said vacuum hose connection end comprising two hollow protrusions both configured to extend from inside said channel in a direction opposite said crevice tool end and sized and shaped to fit inside said intake end of said default nozzle when assembled.

10. The apparatus of claim 9, wherein said nozzle intake opening is angled at its distal end and comprises at least one ridge formed by adjacent notches in said nozzle intake opening.

* * * * *